US010815681B2

(12) United States Patent
Kurtz

(10) Patent No.: US 10,815,681 B2
(45) Date of Patent: Oct. 27, 2020

(54) MODULAR ROOF MOUNTED STAGING BRACKET AND RAIL MEMBERS

(71) Applicant: Eric William Kurtz, Colchester, VT (US)

(72) Inventor: Eric William Kurtz, Colchester, VT (US)

( * ) Notice: Subject to any disclaimer, the term of this patent is extended or adjusted under 35 U.S.C. 154(b) by 54 days.

(21) Appl. No.: 15/792,024

(22) Filed: Oct. 24, 2017

(65) Prior Publication Data

US 2018/0087282 A1 Mar. 29, 2018

Related U.S. Application Data

(63) Continuation of application No. 14/789,864, filed on Jul. 1, 2015, now Pat. No. 9,920,540, which is a continuation-in-part of application No. 14/159,927, filed on Jan. 21, 2014, now abandoned.

(60) Provisional application No. 61/998,574, filed on Jul. 1, 2014, provisional application No. 61/850,027, filed (Continued)

(51) Int. Cl.

| | |
|---|---|
| ***E04G 3/22*** | (2006.01) |
| ***E04G 5/06*** | (2006.01) |
| ***E04G 1/38*** | (2006.01) |
| ***E04G 3/20*** | (2006.01) |
| *E04G 5/14* | (2006.01) |

(52) U.S. Cl.

CPC ..... *E04G 3/22* (2013.01); *E04G 1/38* (2013.01); *E04G 3/20* (2013.01); *E04G 5/062* (2013.01); *E04G 5/144* (2013.01); *E04G 5/145* (2013.01); *Y10T 29/49815* (2015.01)

(58) Field of Classification Search

CPC ..... E04G 3/20; E04G 3/22

See application file for complete search history.

(56) References Cited

U.S. PATENT DOCUMENTS

| | | | |
|---|---|---|---|
| 1,558,425 | A | 10/1925 | Yetter |
| 3,853,203 | A | 12/1974 | Werner et al. |
| 4,074,792 | A | 2/1978 | Zaugg et al. |

(Continued)

FOREIGN PATENT DOCUMENTS

| | | | |
|---|---|---|---|
| CA | 2098905 | A1 | 12/1994 |
| DE | 800338 | C | 10/1950 |

(Continued)

OTHER PUBLICATIONS

Chavchavadze, "Final Rejection", related to U.S. Appl. No. 14/789,864, dated Sep. 1, 2017.

(Continued)

*Primary Examiner* — Colleen M Chavchavadze

(57) ABSTRACT

An apparatus for supporting workers and materials above-grade on both the cave and gable ends of a structure is disclosed. The apparatus can be combined with one or more additional staging apparatuses to create a staging system for the support of persons or materials while work is being done on a structure, e.g., roofing, siding, etc. The modular design of the apparatus simplifies installation, such that it can be readily attached to a roof or other support member of a structure by a single person, and facilitates the adjustable vertical positioning of people or materials along the walls of the structure. The staging system can also include a rail member for safety support and alternative scaffolding arrangements.

6 Claims, 13 Drawing Sheets

Related U.S. Application Data on Feb. 6, 2013, provisional application No. 61/849,265, filed on Jan. 23, 2013.

(56) References Cited

U.S. PATENT DOCUMENTS

| | | | | |
|---|---|---|---|---|
| 4,078,633 | A | 3/1978 | Fahy | |
| 4,256,201 | A | 3/1981 | Neighbors | |
| 4,276,957 | A | 7/1981 | Kilgore | |
| 4,620,612 | A | 11/1986 | Enoki et al. | |
| 4,957,185 | A | 9/1990 | Courchesne et al. | |
| 4,984,654 | A | 1/1991 | Anderson | |
| 5,829,549 | A * | 11/1998 | Flynn | E04G 3/20 182/82 |
| 6,886,662 | B2 | 5/2005 | Riley | |
| 8,025,126 | B1 | 9/2011 | Lefavor | |
| 8,684,137 | B2 | 4/2014 | Collister et al. | |

FOREIGN PATENT DOCUMENTS

| | | | |
|---|---|---|---|
| DE | 806048 | C | 6/1951 |
| DE | 812207 | C | 8/1951 |
| DE | 2504348 | A1 | 8/1976 |
| DE | 3224525 | A1 | 1/1984 |
| DE | 102009013463 | A1 | 9/2010 |
| IT | 1215354 | A3 | 11/2003 |

OTHER PUBLICATIONS

Chavchavadze, "Notice of Allowance", related to U.S. Appl. No. 15/056,659, dated Nov. 24, 2017.

Chavchavadze, "Notice of Allowance and Fee(s) Due", related to U.S. Appl. No. 14/789,864, dated Nov. 8, 2017.

Chavchavadze, "USPTO Advisory Action Before the Filing of an Appeal Brief", related to U.S. Appl. No. 14/159,927, dated Nov. 17, 2015.

Chavchavadze, "USPTO Final Office Action", related to U.S. Appl. No. 14/159,927 dated Aug. 20, 2015.

Chavchavadze, "USPTO Non-Final Office Action", related to U.S. Appl. No. 14/159,927, dated Mar. 6, 2015.

McCabe, "Response to Office Action", related to U.S. Appl. No. 14/159,927, dated Oct. 26, 2015.

McCabe, "Response to Office Action", related to U.S. Appl. No. 14/159,927 dated May 21, 2015.

* cited by examiner

MODULAR ROOF MOUNTED STAGING BRACKET AND RAIL MEMBERS

RELATED APPLICATION DATA

This application is a continuation of U.S. patent application Ser. No. 14/789,864, filed Jul. 1, 2015, and titled "Modular Roof Mounted Staging; Bracket and Rail Members," which is a continuation-in-part of U.S. patent application Ser. No. 14/159,972, filed Jan. 21, 2014, and titled "Modular Roof Mounted Staging Bracket", which claims the benefit of priority of U.S. Provisional Patent Application No. 61/849,265, filed Jan. 23, 2013, and titled "Safety Staging Bracket", and U.S. Provisional Patent Application No. 61/850,027, filed Feb. 6, 2013, and titled "Safety Staging Bracket", and which claims the benefit of priority of U.S. Provisional Application No. 61/998,574, filed Jul. 1, 2014, and titled "Back Side Safety Rail", each of which is incorporated by reference herein in its entirety.

FIELD OF THE INVENTION

The present invention generally relates to devices used in the construction industry for supporting persons or materials above ground. In particular, the present invention is directed to a Modular Roof Mounted Staging Bracket that can be used with additional modular room mounted staging brackets to form a modular roof mounted staging system.

BACKGROUND

Scaffolding is usually a temporary structure used to support people, materials, work surfaces, etc., well above ground level so as to facilitate the construction or repair of buildings (roofing, siding, painting, etc.). Traditional scaffolding is a system of metal pipes or tubes, wood, etc., that are joined together to form a structure based at ground level that has a height sufficient to allow workers to access the necessary work zone, e.g., roof, eaves, sidewalls, etc.

Yet, traditional scaffolding presents several problems: 1) to provide the appropriate structural strength, scaffolding is typically quite heavy and cumbersome; 2) in some instances a special rigger licensing may be required for installation and use of scaffolding; 3) it can be time consuming to set up and take down scaffolding supports; and 4) the surface where the scaffolding is to be placed can be uneven, soft, or otherwise present issues to providing a safe scaffolding structure.

What is needed is a staging bracket that readily supports workers, tools, and materials, at a desired distance above ground-level. The scaffolding system should be portable, readily set up and removed, and adjustable to allow workers fall access to the roof and sides of the structure including both cave and gable ends of the structure.

SUMMARY OF THE DISCLOSURE

In a first exemplary aspect a rail member is disclosed that is coupleable to a staging platform having a sidewall with a plurality of apertures extending therethrough, the rail member comprising a stanchion with a plurality of support bracket apertures; a cross-member coupled to the stanchion; and a plurality of platform engagement members coupled to the cross-member, wherein, when the rail member is in use, ones of the plurality of platform engagement members are inserted into corresponding respective ones of the plurality of apertures and coupled to the staging platform.

In another exemplary aspect, a scaffolding system capable of attaching to an cave and gable end of a structure is described, the system comprising a first scaffolding device having a first support structure, a first wall engagement member, and a first roof engagement member, wherein portions of the first support structure, the first wall engagement member, and the first roof engagement member are longitudinally adjustable; a second scaffolding device having a second support structure, a second wall engagement member, and a second roof engagement member, wherein portions of the second support structure, the second wall engagement member, and the second roof engagement member are longitudinally adjustable; a platform having a sidewall with a plurality of apertures extending therethrough, wherein when the first scaffolding device and the second scaffolding device are coupled to the roof, the platform rests on the first support structure and the second support structure; and at least one rail member, each of the at least one rail members including: a stanchion with a plurality of support bracket apertures; a cross-member coupled to the stanchion; and a plurality of platform engagement members coupled to the cross-realer, wherein, when the rail member is in use, ones of the plurality of platform engagement members are inserted into corresponding respective ones of the plurality of, apertures and coupled to the platform.

In yet another exemplary aspect, a rail system is described that comprises a platform, at least two rail members, each of the at least two rail members attached to the platform and including: a stanchion with a plurality of support bracket apertures; a cross-member coupled to the stanchion; and a plurality of platform engagement members coupled to the cross-member, wherein, when the rail member is in use, ones of the plurality of platform engagement members are inserted into corresponding respective ones of the plurality of apertures and coupled to the platform; and at least two safety rails, wherein at least one of the at least two safety rails is coupled to one of the stanchions such that a user is prevented from falling from an end of the platform.

BRIEF DESCRIPTION OF THE DRAWINGS

For the purpose of illustrating the invention, the drawings show aspects of one or more embodiments of the invention, wherein like elements in the drawings are represented by like numbers. However, it should be understood that the present invention is not limited to the precise arrangements and instrumentalities shown in the drawings, wherein.

DESCRIPTION OF THE DISCLOSURE

A staging bracket according to the present disclosure is a safe, adaptable, and easily deployed apparatus that may be combined with one or more staging brackets to create a staging system for the support of persons or materials while work is being done on a structure, e.g. roofing, siding, etc. The staging bracket has a modular design that simplifies installation, such that it can be readily attached to a roof or other support member of a structure by a single person, and facilitates the adjustable vertical positioning of people or materials along the walls of the structure. The staging bracket can be attached to any structural roofing member, including most any type of existing roofing material, e.g., shingle, standing seam, corrugated, etc., on new or existing roofs of any pitch and can be attached along either the cave or gable ends of the structure.

Figure 1:
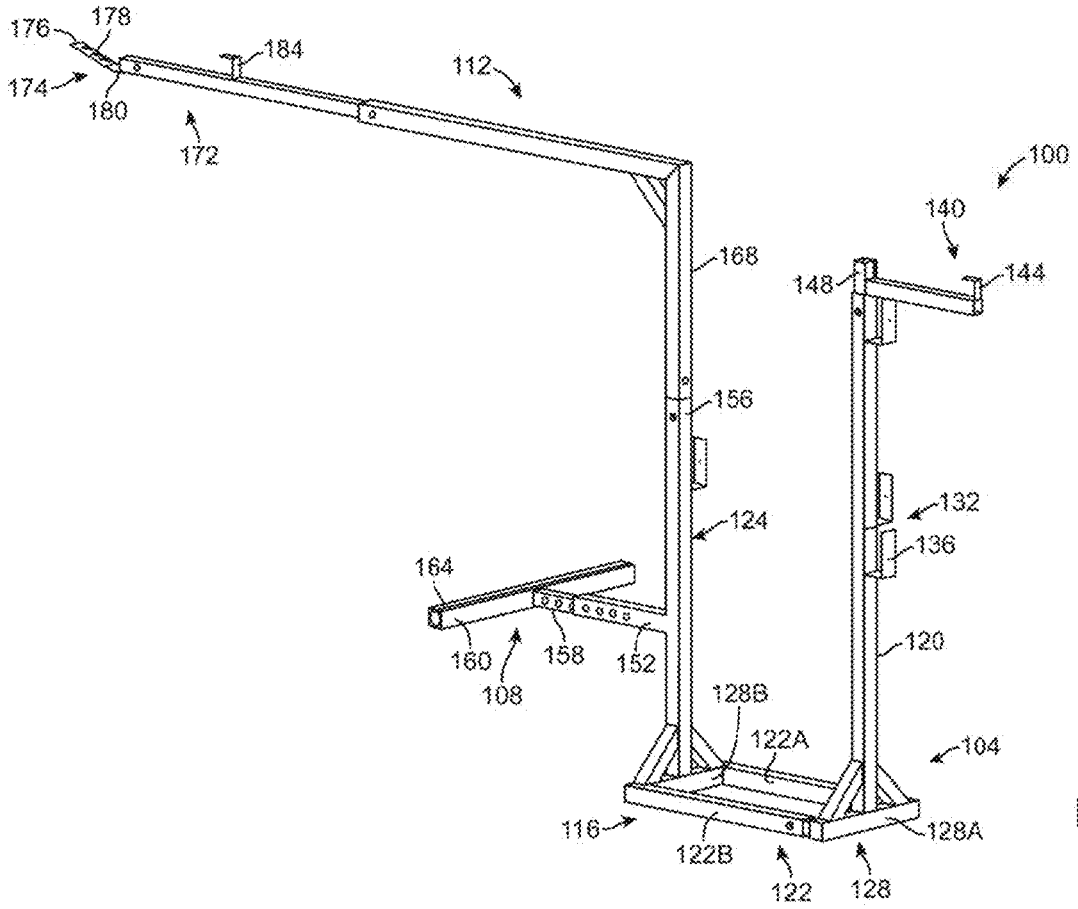
FIG. 1 is a perspective view of a staging bracket according to an embodiment of the present invention.

Turning now to the figures, FIG. 1 shows an exemplary staging bracket 100 according to an embodiment of the present disclosure. At a high level, staging bracket 100 includes a support platform 104, a wall engagement member 108, and a roof engagement member 112. These three components serve to provide a support surface for persons and/or materials when staging bracket 100 is in use, stabilize the staging bracket against the structure, and to attach staging bracket 100 to a structural member on the structure.

Support platform 104 provides a safe, supportive surface for people and/or materials when staging bracket 100 is installed above ground-level and when used with additional ones of the staging brackets. In an exemplary embodiment, support platform 104 includes a support deck 116, an outer rail 120, and an inner rail 124. Support deck 116 is generally sized and configured to support a portion of one or more planks (not shown in FIG. 1), on which persons or materials would rest when staging bracket 100 is in use. As shown in FIG. 1 support deck 116 is generally rectangular in shape having multiple support members 122, which provide support and stability for workers standing upon a plank. The length of support members 122 (122A-B) being generally sufficient to allow a plank to rest proximate the support members. In an alternative embodiment, support deck 116 may only have a single support member 122 (not shown) extending between outer rail 120 and inner rail 124.

Outer rail 120 and inner rail 124 are coupled to opposing sides 128, e.g., sides 128A-B, of support deck 116, with the outer rail and inner rail being substantially orthogonal to the support deck. Outer rail 120 is generally sized and configured to reduce the possibility that a person would fall from the elevated position of the staging by providing support for one or more brace members (FIG. 4) that reside above the plank. The overall longitudinal length of outer rail 120 may be adjustable by, for example, providing nested tubular structures (not shown) that can be adjusted in increments of, for example, 1 inch.

Figure 2:
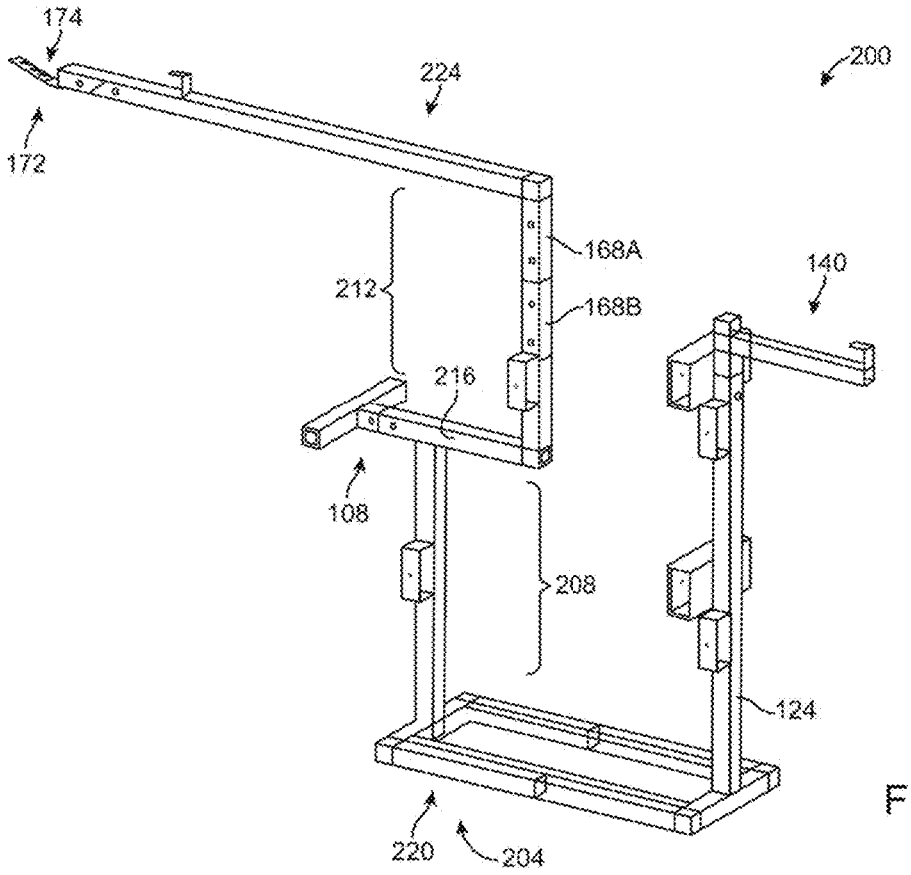
FIG. 2 is a perspective view of a staging bracket according to another embodiment of the present invention.
Figure 3:
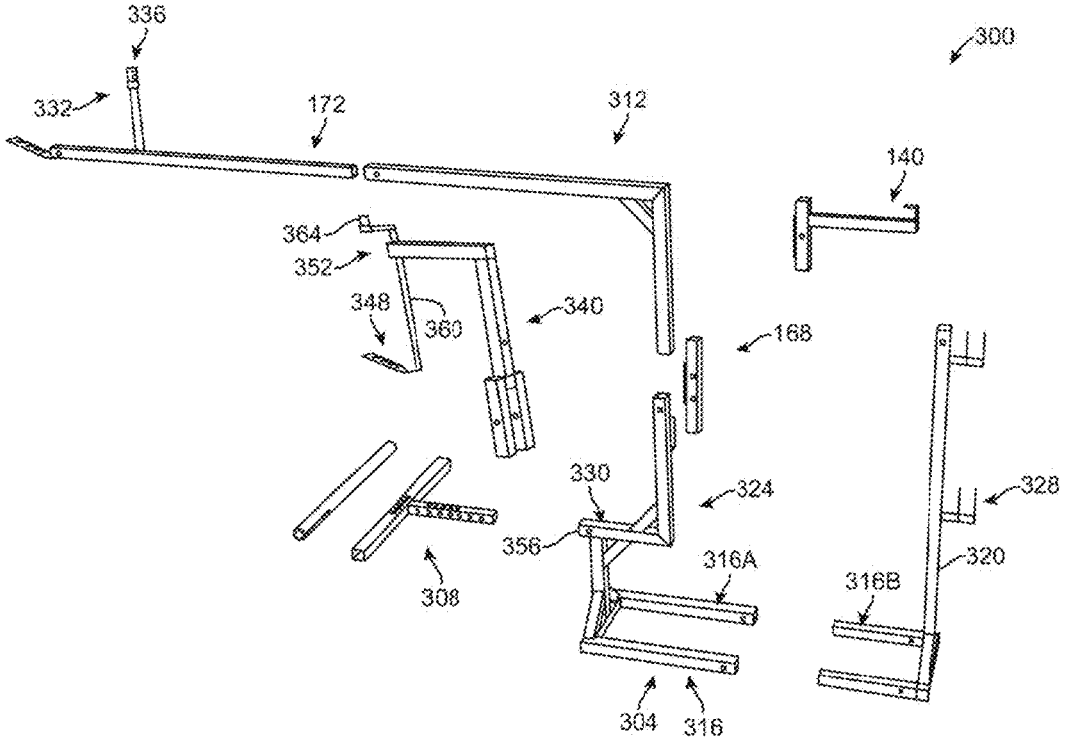
FIG. 3 is an exploded perspective view of a staging bracket according to another embodiment of the present invention.

In the embodiment shown in FIG. 1, outer rail 120 includes a plurality of brace holders 132. Brace holders 132 are sized and configured to receive brace members (shown in FIG. 4). For example, the brace members could be 2×4 boards and brace holders 132 could be sized and configured to support the 2×4 boards. Securing of the brace members to brace holders 132 can be accomplished by methods known in the art such as press fit or otherwise nailed or fastened through apertures, such as apertures 136, provided in the brace holders. The number, design, and configuration of brace holders 132 may vary according to safety requirements of the jurisdiction of use or the needs of the crew using staging bracket 100. For example, alternative brace holders 132 are shown in FIGS. 2 and 3.

In an exemplary embodiment, outer rail 120 also includes a shelf bracket 140. Shelf bracket 140 is sized and dimensioned to support an portion of a shelf (shown in FIG. 4). Shelf bracket 140 can include one or more shelf flanges 144 that assist in securing a shelf in position. In certain embodiments shelf bracket 140 can be integral with outer rail 120, or, and as shown in FIG. 1, can include a shelf adjuster 148 that is configured to mate with the outer rail 120 so as to allow for height adjustment of the shelf bracket. In an exemplary embodiment, shelf adjuster 148 is a tubular structure designed to nest within outer rail 120. In this embodiment, a plurality of apertures are provided in increments along the longitudinal axis of shelf adjuster 148 and at least one aperture is included with outer rail 120. A pin or bolt can be used to couple shelf adjuster 148 to outer rail 120 when their respective apertures align.

Inner rail 124 serves to connect support platform 104 to, wall engagement member 108. In an exemplary embodiment, inner rail 124 extends orthogonally away from support deck 116 and is releasably coupled to wall engagement member 108 via a first receiver 152 and is releasably coupled to roof engagement member 112 via a second receiver 156. In this embodiment, first receiver 152 and second receiver 156 each include apertures for securing the components of staging bracket 100 together using pins or other connectors known in the art. Inner rail 124 can also include one or more brace holders 132 as needed or desired.

Wall engagement member 108 positions staging bracket 100 a suitable distance from the edge of the structure the staging bracket in an appropriate position for receiving people and or materials. In an exemplary embodiment, wall engagement member 108 includes an extendable wall tube 158 that has Oil its distal end a bumper 160. Wall tube 158 is sized and configured to slidably engage with first receiver 152 and to be connected thereto, such as by pins or other connectors through apertures in the wall tube and the first receiver. Bumper 160 rests against the structure when staging bracket 100 is installed. Bumper 160 can include a covering 164, such as a rubber membrane, that prevents marring or other types of deformation of the structure. Wall engagement member 108, via wall tube 158, can be adjusted (extended or retracted) so as to properly position stating bracket 100 and/or to avoid soffits or gutters if necessary. As shown in FIG. 1, wall engagement member 108 has a partially nested tubular construction that facilitates lengthening or shortening, the wall engagement member in fixed increments, although other types of construction facilitate extension or retraction may be used. A pin (not shown) inserted into corresponding apertures in wall tube 158 and first receiver 152 may be used to fix the length of wall engagement member 108.

Roof engagement member 112 is coupled to outer rail 124 via second receiver 156 and is extendable, both horizontally and vertically, so as to facilitate attachment to various root configurations and pitches. In an exemplary embodiment, roof engagement member 112 is composed of a plurality of at least partially testable tubular structures that allow for expansion or retraction of the roof engagement member in the horizontal and vertical directions (relative to the ground when installed) at fixed intervals, e.g., 1 inch. For example, and as shown in FIG. 1, roof engagement member 112 may include a tubular structure 168 that allows for extension or retraction in the vertical direction. Additional tubular structures 168, such as 168A-B (shown in FIG. 2) or 168C (shown in FIG. 4), may be included to further extend the vertical range of use of staging bracket 100. Tubular structure 168 may be connected to additional tubular structures or outer rail 120 using pins, spring-snaps, or other connectors known in the art.

In an alternative embodiment, roof engagement member 112 extends or retracts by rotating one portion of the roof engagement member relative to another portion of the roof engagement member (not shown). In another alternative embodiment, one or more additional portions of roof engagement member 112 may be coupled together using connectors or other coupling mechanisms known in the art (not shown).

Roof engagement member 112 includes a removable coupling 172. Removable coupling 172 facilitates secure, yet adjustable, attachment to the structure. As shown in FIG. 1, coupling 172 is a shingle coupling 174 that has an articulable flange 176 with a plurality of apertures 178 for receiving a corresponding respective number of fasteners (not shown). Articulable flange 176 can be rotated using a hinge, such as hinge 180 or can rotatable using other mechanisms known in the art, Other forms of coupling 172 configured for other roof structure members, e.g., different roofing materials, are discussed further below with reference to FIGS. 5A-5B.

Roof engagement member 112 may also include a cleat holder 184, which receives a cleat (shown in FIG. 4) that supports crew members when working further up the roof line of the structure.

In an exemplary embodiment, support platform 104, wall engagement member 108, and roof engagement member 112 are largely made from aluminum square tubing so that staging bracket 100 is light and durable, although other materials, such as square steel, or rounded tubing could be used.

FIG. 2 shows another exemplary embodiment of a staging bracket according to the present disclosure, staging, bracket 200. While in many ways similar to staging bracket 100, staging bracket 200 includes a support platform 204, the configuration of which provides for variable width planks for supporting, workers, while accommodating the need for staging bracket to be mountable around a soffit and/or gutter extending from the roof. In increased surface area for a plank is accomplished by providing a bump out 208, which undercuts a roof extension area 212. Bump out 208 is formed between a wall engagement member receiver 216 and a support deck 220.

Staging bracket 200 also includes an alternative embodiment of roof engagement member 112, roof engagement member 224. Roof engagement member 224 has a plurality of at least partially nestable tubular structures 168, tubular structures 168A-B, that allow for expansion or retraction of the roof engagement member in the vertical direction thereby allowing for staging bracket 200 to be placed at desired vertical positions along the structure to facilitate work such as painting or siding of the sides of the structure.

Figure 4:
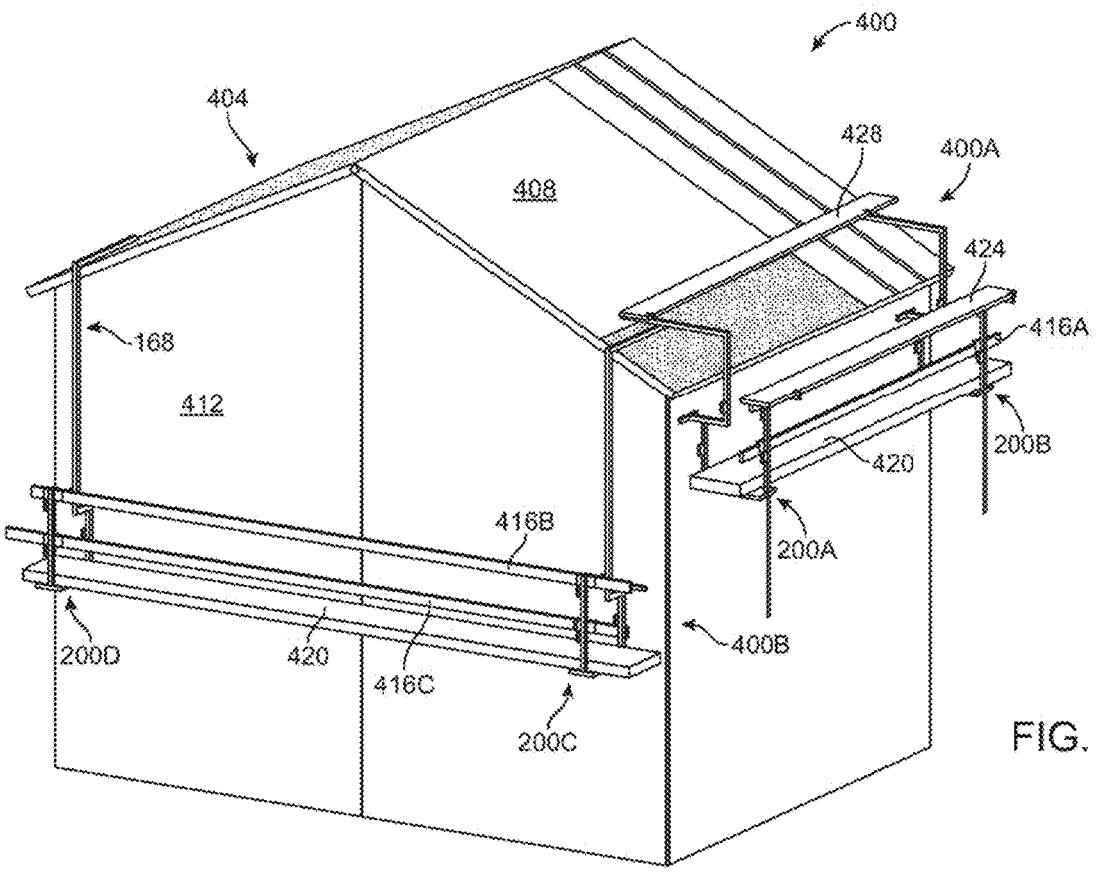
FIG. 4 is a perspective view of multiple staging brackets used to form several staging systems according to yet another embodiment of the present invention.

FIG. 3 shows an exploded view of another exemplary embodiment of a staging bracket, staging bracket 300. Staging bracket 300 includes a support platform 304, a wall engagement member 308, and a roof engagement member 312. Support platform 304 includes a support surface 316, outer rail 320, and inner rail 324. Support surface 316 is divided into one or more portions, e.g., 316A-B, so as to Facilitate the placement of a plank during installation of a staging system, such as staging system 400A (FIG. 4). The size and dimensions of portion 316A should be such that it would support the plank while portion 316E is brought up for assembly with portion 316A.

Outer rail 320 is coupled to portion 316B and can include one or more brace holders 328 that can support brace members. As shown in FIG. 3, brace holders 328 are configured to provide for multiple, side-by-side, brace members for additional safety. Inner rail 324 is coupled to portion 316A and receives wall engagement member 308 via first receiver 330.

As with roof engagement members 112 and 224, roof engagement member 312 includes multiple tubular structures 168 that can be used to extend or retract the vertical (relative to ground-level) range of the roof engagement member, Roof engagement member 312 may also include a stabilizing bar 332 proximate a distal end of removable coupling 172. Stabilizing bar 332 provides support for staging bracket 300 and dampens swaying of the staging bracket when in use. Stabilizing bar 332 includes a coupling mechanism 336 that allows for attachment to the structure. As shown in FIG. 3, coupling mechanism 336 is an articulable coupling with a plurality of apertures for receiving fasteners. Alternative coupling mechanisms 336 may be employed depending up on the type of surface staging bracket 300 is being mounted on. Roof engagement member 312 is also sized and configured to accommodate the simultaneous positions of extension 340, which is discussed in mote detail just below.

Staging bracket 300 can also include an extension 340. When roofing a structure, as workers come close to coupling mechanism 336 and/or coupling 172, they may skip an area where the coupling mechanism or coupling attaches to the roof and then return on a ladder to complete the roofing after the staging bracket has been removed. In order to avoid this inefficiency, extension 340 provides an alternative attachment point on the roof so that workers can apply, roofing materials at the location where coupling 172 and/or coupling mechanism 336 were attached to the roof without having to remove staging bracket 300. As shown, extension 340 includes an articulable extension coupling 348 and a jack 352. The configuration of extension 340 is such that articulable extension coupling 348 attaches to the roof at a point below the roofline from coupling 172. In use, extension 340 is attached to inner rail 324 proximate first receiver 330 at attachment point 356 using pins or other connectors known in the art and then coupled to the roof using extension coupling 348. Jack 352 is then adjusted (e.g., extended) so as to relieve downward pressure on roof engagement member 312. In an exemplary embodiment, jack 352 is a screw jack, which, when operated, lowers or raises a jack support 360 using a rotator 364. Coupling 172 is then decoupled from the roof as a large portion of the downward pressure has been relieved by extension 340. Once coupling 172 is removed, workers can apply roofing materials to the former location of coupling 172 and/or coupling mechanism 336 and then reattach coupling 172 and/or coupling mechanism 336 to the roof (and possibly changing the type of coupling mechanism if necessary to accommodate the newly installed roofing material).

Turning now to FIG. 4, there is shown multiple exemplary staging brackets that area part of multiple staging, systems 400. e.g., staging systems 400A-B, attached to a structure 404. As mentioned previously, one of the many advantages of staging brackets according to the present disclosure are their adaptability, which is on display in FIG. 4. As shown, staging system 400A includes a pair of staging brackets 200 (FIG. 2), i.e., staging brackets 200A-B, (although more could be used) that are each mounted to a roof 408 of structure 404. In this application, each staging bracket 200 includes a different coupling 172 because staging bracket 200A (closest to front of the page) needs to mount to a flat surface, such as plywood, and staging bracket 200B needs to mount to a standing seam roof. Coupling 172 for staging bracket 200B is similar in configuration to that described with FIG. 1, whereas coupling 172 for staging bracket 200E is similar in configuration to that shown in FIG. 5B.

Staging system 400B also includes a pair of staging brackets 200, i.e., staging brackets 200C-D, (although more could be used) that are mounted to a gable end 412 of structure 404, thus exemplifying one of the many benefits of the staging brackets as disclosed herein. Staging system 400B allows persons and/or materials to travel vertically along gable end 412 using additional tubular structures 168.

As discussed previously, each of the staging brackets discussed herein can include one or more brace holders, such as brace holder 132 (FIG. 1) for supporting braces. Examples of such implementations are shown in FIG. 4. For example, staging system 400A includes one brace member 416A, while staging system 400B includes a pair of parallel brace members 416B-C. Additional or alternative position of brace members is possible. Each staging system 400 also includes a plank 420 suitable for carrying workers and/or materials. Staging system 400A also includes two additional work shelves, a rear shelf 424 and a roof cleat 428 that mate with shelf brackets, such as shelf bracket 140, and cleat holders, such as cleat holder 184 (FIG. 1).

Figure 5A:
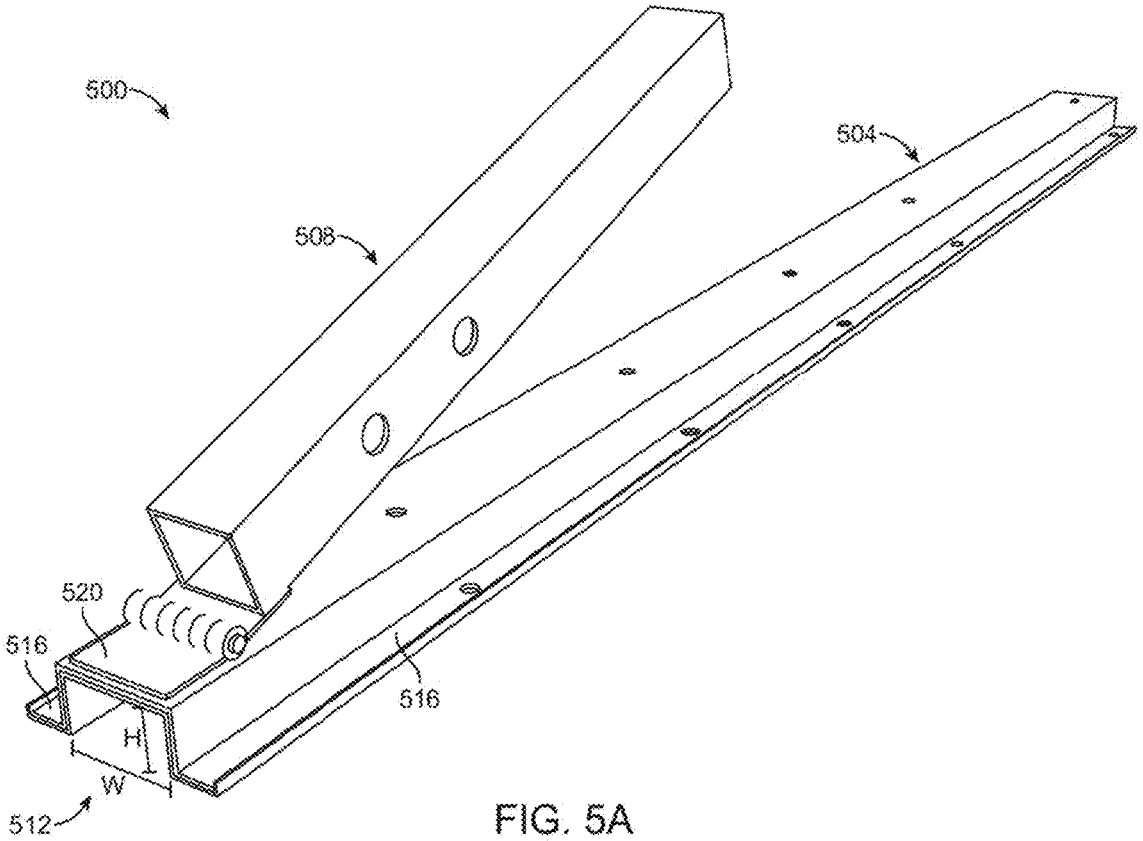
FIG. 5A is a perspective view of a roof attachment according to an embodiment of the present invention.

Turning, now to exemplary embodiments of coupling 172, there is shown on FIG. 5A a coupling 500 suitable for use with a roof having corrugated roofing. Coupling 500 has a roof member 504 rotatably coupled to a connecting member 508. Roof member 504 sized and configured to be mountable on the corrugated roofing. In an exemplary embodiment, roof member 504 includes a channel 512 that has a height, H, and a width, W, sufficient to be positioned over a ridge in the corrugated roofing material. On each side of channel 512 is a flange 516 that include a plurality of apertures for affixing roof member 504 to the roof Apertures are including both in channel 512 and flanges 516 so as to accommodate different roofing styles (roofers have differing techniques for securing corrugated roofing to the roof of a structure).

In an exemplary embodiment, roof member 504 is coupled to connecting member 508 using a hinge 520. Hinge 520 facilitates the rotation of roof member 504 relative to connecting member 508, whereby when a staging bracket, such as staging bracket 100, is being deployed, coupling 500 can be mounted to the roof and the remainder of the staging bracket can be adjusted so as to provide a suitable working surface. In this way, coupling 500 serves to adapt any of the aforementioned staging brackets to roofs having different pitches.

Connecting member 508 is configured to mate with the remainder of roof engagement member 112. As shown, connecting member 508 is a designed to nest within a portion of roof engagement member 112 and the apertures in connecting member 508 are configures so as to mate with corresponding apertures in roof engagement member. Thus, coupling 500 can be joined to roof engagement member using pins or other mechanisms known in the art. Advantageously, coupling 500 (or other couplings discussed herein) can be mounted to the roof first and then the remainder of the staging bracket brought up and connected to the coupling, thereby easing assembly on the roof.

Figure 5B:
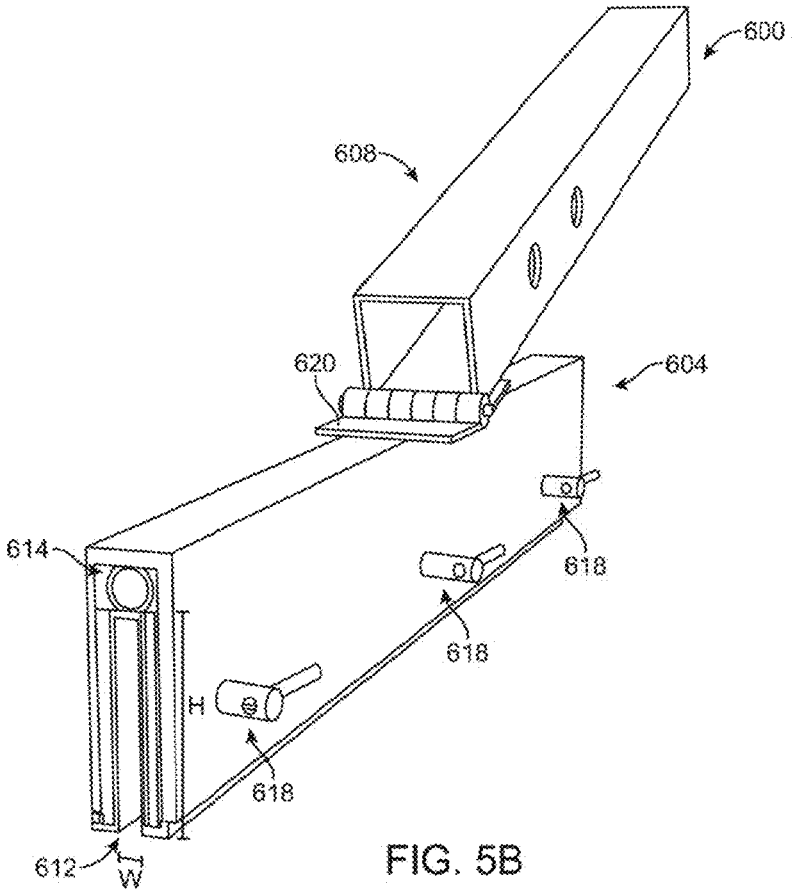
FIG. 5B is a perspective view of another roof attachment according to an embodiment of the present invention.

FIG. 5B shows another exemplary coupling, coupling 600. Coupling 600 is suitable for use with a roof having standing seam style metal roofing, Coupling 500 has a roof member 604 rotatably coupled to a connecting member 608. Roof member 604 is sized and configured to be mountable on the standing seam roofing. In an exemplary embodiment, roof member 604 includes an internal channel 612 that has a height, H, and a width, W, sufficient to be positioned over the flange protruding where adjacent pieces of the metal roofing material meet. Roof member 604 also includes an outer channel 614 sized and configured to substantially encase internal channel 612.

The width, W, of internal channel 612 is alterable so as to secure coupling 600 to the protruding flange. In an exemplary embodiment, channel 612 is expanded by a torsion spring or similar device located between internal channel 612 and outer channel 614. In an alternative embodiment channel 612 is formed by a hinge, such as a piano hinge, that is rotatable within outer channel 614, The width of channel 612 is reducible by using one or more clamps, set-screws (such as set-screws 618), or similar devices that press against one or more sidewalls of internal channel 612, compressing it against the flange protruding from the metal roof and keeping coupling 600 secured in place.

In an exemplary embodiment, roof member 604 is coupled to connecting member 608 using a hinge 620. Hinge 620 facilitates the rotation of roof member 604 relative to connecting member 608, whereby when a staging bracket, such as staging bracket 100, is being deployed, coupling 600 can be mounted to the roof and the remainder of the staging bracket can be adjusted so as to provide a suitable working; surface. In this way, coupling 600 serves to adapt any of the aforementioned staging brackets to roofs having different pitches.

Connecting member 608 is configured to mate with the remainder of roof engagement member 112 (e.g., FIG. 1). As shown, connecting member 608 is a designed to nest within a portion of roof engagement member 112 and the apertures in connecting member 608 are configures so as to mate with corresponding apertures in roof engagement member. Thus, coupling 600 can be joined to roof engagement member using pins or other mechanisms known in the art. Advantageously, coupling 600 (or other couplings discussed herein) can be mounted to the roof first and then the remainder of the staging bracket brought up and connected to the coupling, thereby easing assembly on the roof.

Figure 6:
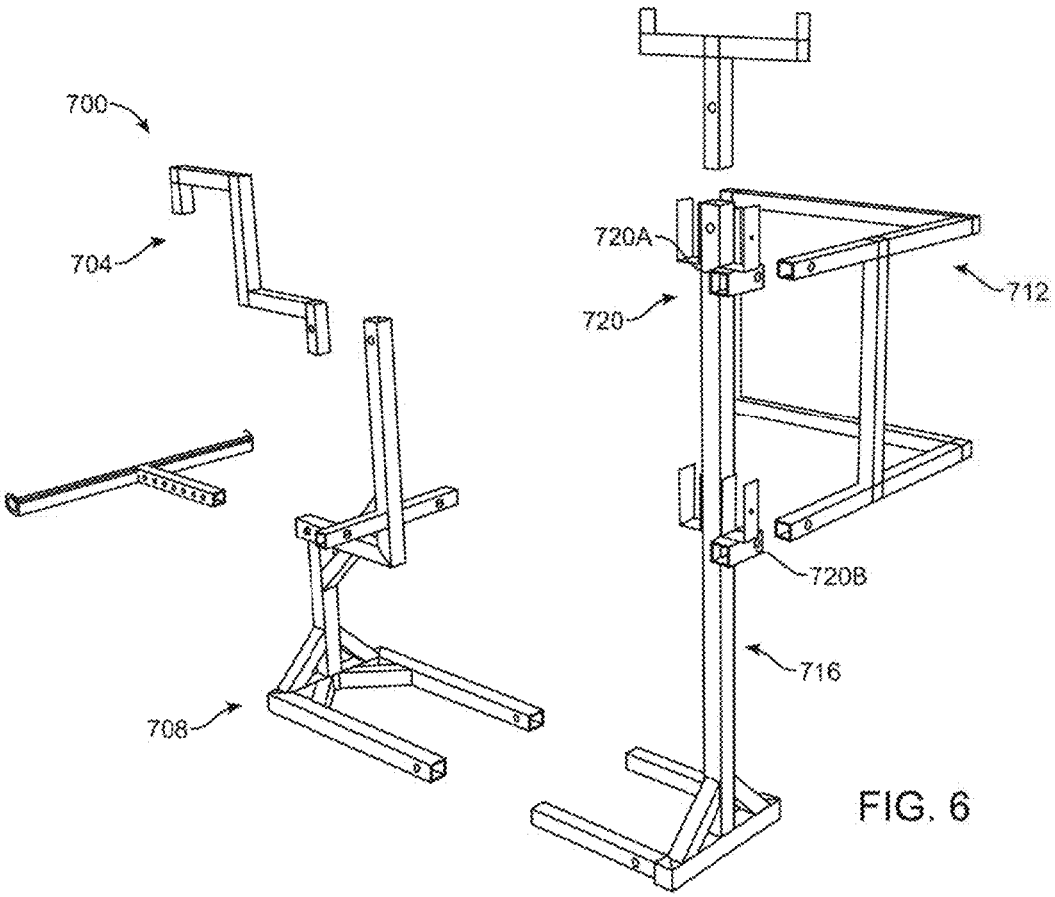
FIG. 6 is an exploded perspective view of a staging bracket according to another embodiment of the present invention.

FIG. 6 shows yet another embodiment of a staging bracket, staging bracket 700. Staging bracket 700 is similar to staging bracket 300 shown in FIG. 3, but with a few significant differences. For example, staging bracket 700 includes a truss support 704 that is releasably coupled to a support platform 708 (which is similar in design and structure to support platform 304) and does not include roof engagement member 312 (although it could be added as an additional roof support). Truss support 704 is sized and configured to hook overtop of a sidewall of the structure (best seen in FIG. 7), and when installed as a staging system (as seen in FIG. 7), it allows persons to work on structures that do not have a roof or only have rafters.

Staging bracket 700 also includes an end rail support 712 that couples to outer rail 716 (which is similar in design and structure to outer rail 320). To accommodate the addition of end rail support 712, outer rail 716 includes a pair of coupling members 720, e.g., 720A-B, that are sized and configured to receive ends of the end rail support. As shown in FIG. 7, end rail supports 712 sized and configured to prevent persons from falling off the sides of staging system.

Figure 7:
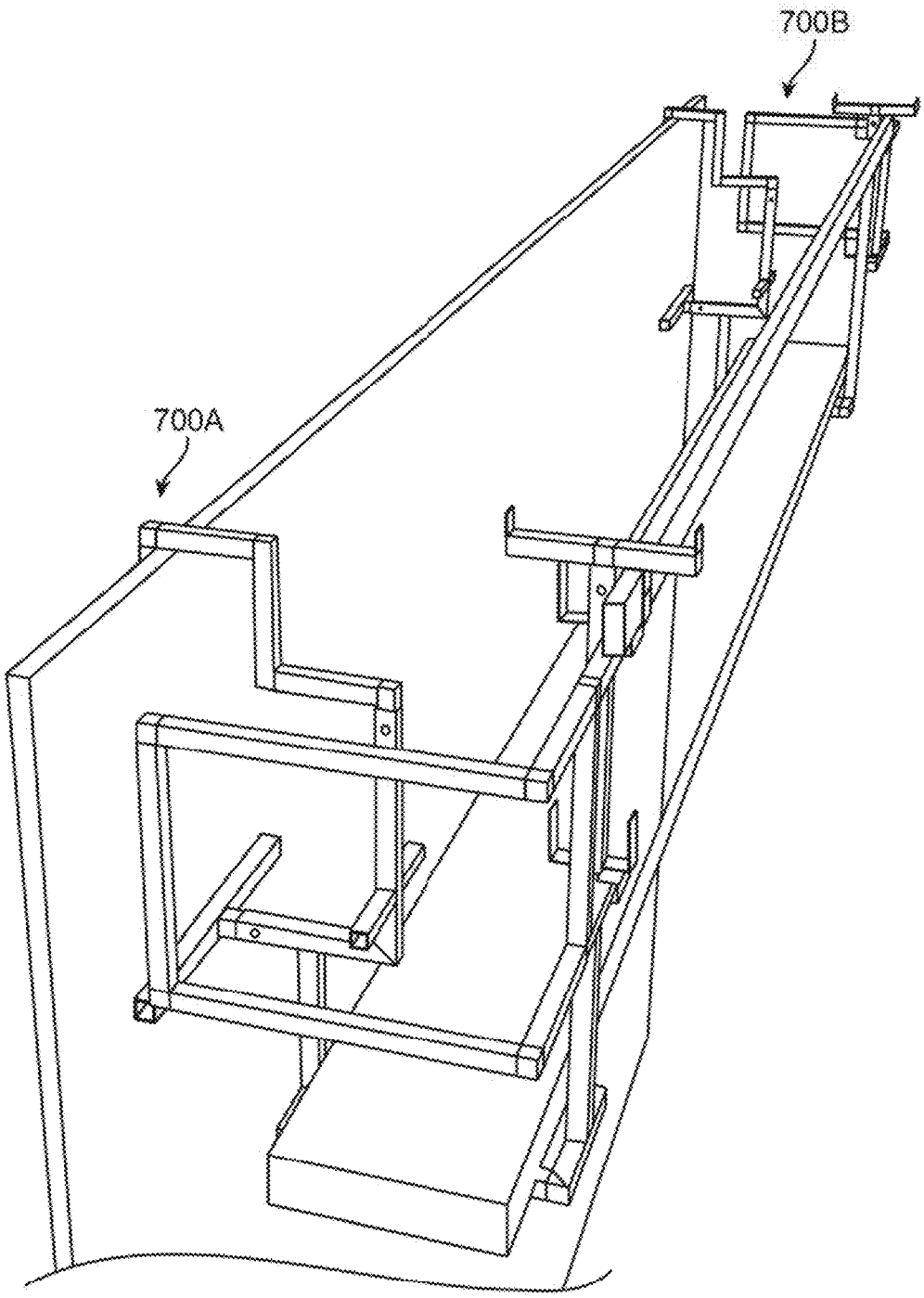
FIG. 7 is a perspective view of a pair of staging brackets combined to form a staging system according to another embodiment of the present invention.

When staging bracket 700 is combined with one or more staging brackets, such as staging brackets 700A and 700B, a staging system, as shown in FIG. 7, is created and is suitable for supporting persons and/or materials. As shown, the staging system allows person to work along the edge of a structure when roofing materials have not be affixed to the structure's rafters.

Figure 8:
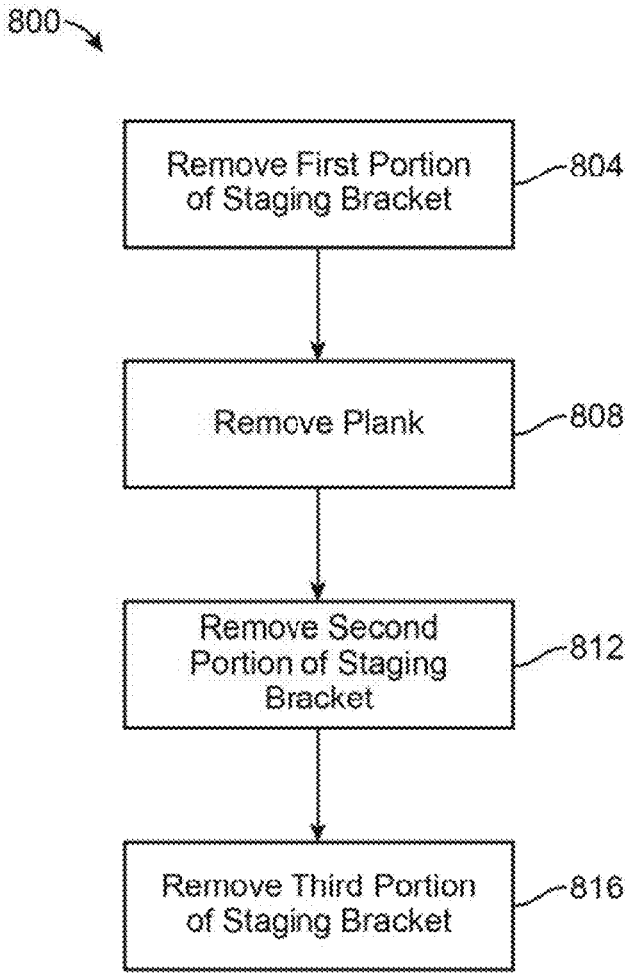
FIG. 8 is a block diagram of a method of removing a staging bracket according to an embodiment of the present invention.

Turning now to FIG. 8, there is shown a method 800 of removing a staging bracket from a shingled roof. At step 804, a first portion of the staging bracket is removed by uncoupling it from the remainder of the staging bracket. In an exemplary embodiment, the first portion is an outer rail.

At step 808, a plank is removed, if applicable, from the support platform of the staging bracket.

At step 812, a second portion of the staging bracket is removed by uncoupling it from the portion of the staging bracket affixed to the roof. In an exemplary embodiment, the second portion is the inner rail and wall engagement member.

At step 816, a third portion of the staging bracket is removed by moving the portion in upward direction following the pitch of the roof. In an exemplary embodiment, the third portion is the roof engagement member.

Figure 9:
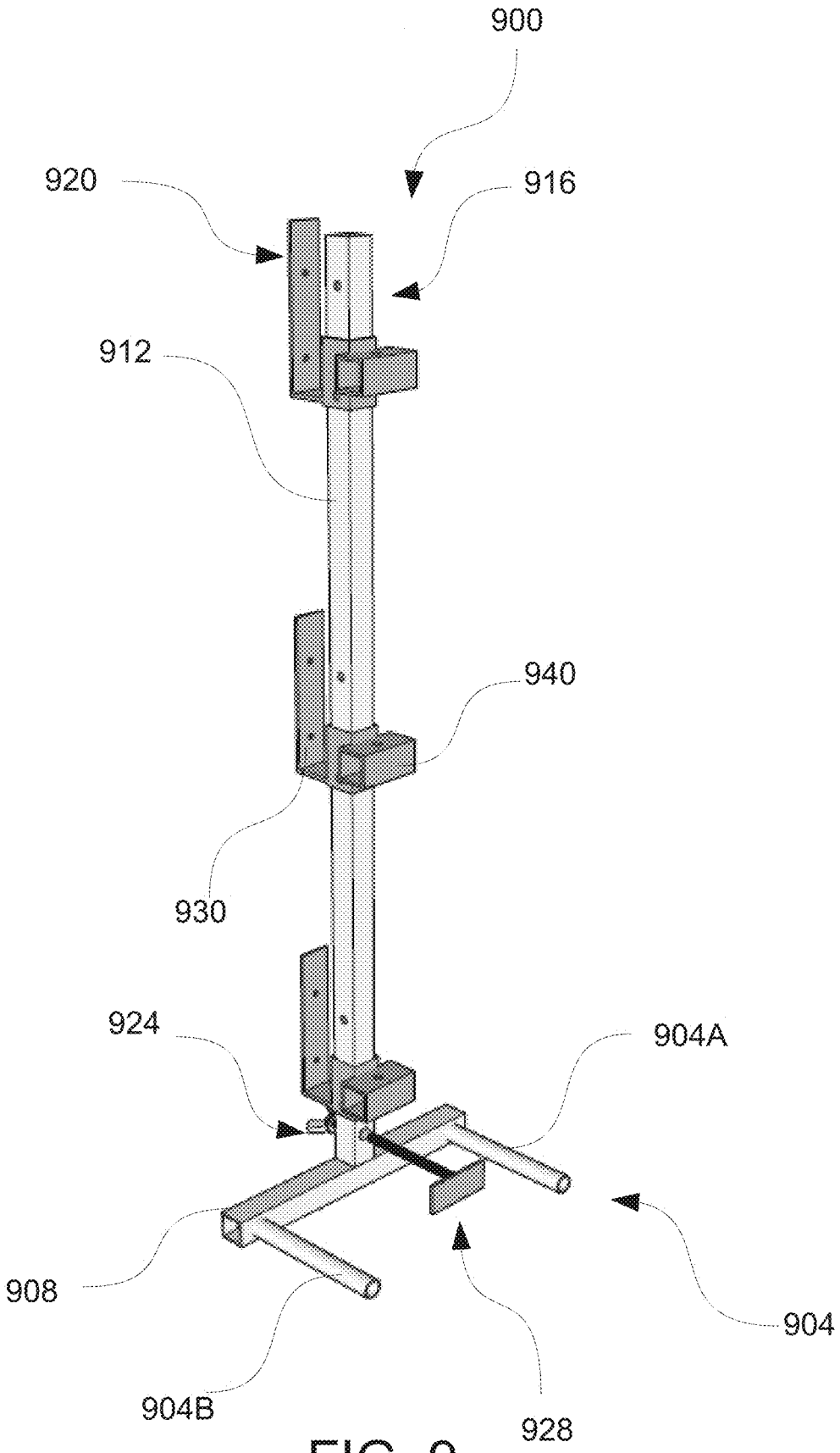
FIG. 9 is a perspective view of a rail member according to an embodiment of the present invention.

Turning now to FIG. 9, there is shown a rail member 900. Rail member 900 can be used in conjunction with a staging system, such as staging system 400A, so as to provide extra support and safety for users of the staging system or can be used with a railing system, such as railing system 1000 (FIGS. 11 and 12), that allows versatility for assembly around various portions of a structure, such as a window. As shown, rail member 900 includes a plurality of platform engagement members 904, e.g., members 904A and 904B, which are sized and configured to be insertable into apertures in a sidewall of a platform, such as support platform 104 (FIG. 1). Platform engagement members 904 are coupled to connector 908. In certain embodiments, platform engagement members 904 may be releaseably coupled to connector 908 such that different ones of platform engagement members 904 (e.g., different lengths or shapes) may be coupled to connector 908 for insertion into a platform.

Extending substantially perpendicular from connector 908 is a stanchion 912. Stanchion 912 includes a plurality of apertures 916 that allow for the mounting of brace holders 920 (which are similar to brace holders 132, discussed above). Stanchion 912 also includes a mounting aperture 924 that facilitates the mounting of rail member 900 to a platform, such as support platform 104 (FIG. 1), via a plank retainer 928 (best seen in FIG. 10, which is discussed further below).

Brace holders 920 assist with ensuring a safe working platform by restricting user movement off of the support platform both laterally and longitudinally. In an exemplary embodiment, brace holders 920 include a bracket 930 that can assist in supporting a brace member 932 (shown in FIGS. 11 and 12), which, as discussed above, prevent users from falling off the platform. In another exemplary embodiment, brace holders 920 can also include a safety rail support 940 that allows for the connection of an end safety rail 944 (shown in FIGS. 11 and 12), which prevents a user from failing off the end of platform 936. An end safety rail 944 can attach to brace holders 920 via pins or other methodologies known in the art. As shown, more than one brace holder 920 on each stanchion 912 so as to provide for coupling to multiple brace members 932 and end safety rails 944 (example shown in FIGS. 11 and 12).

Figure 10:
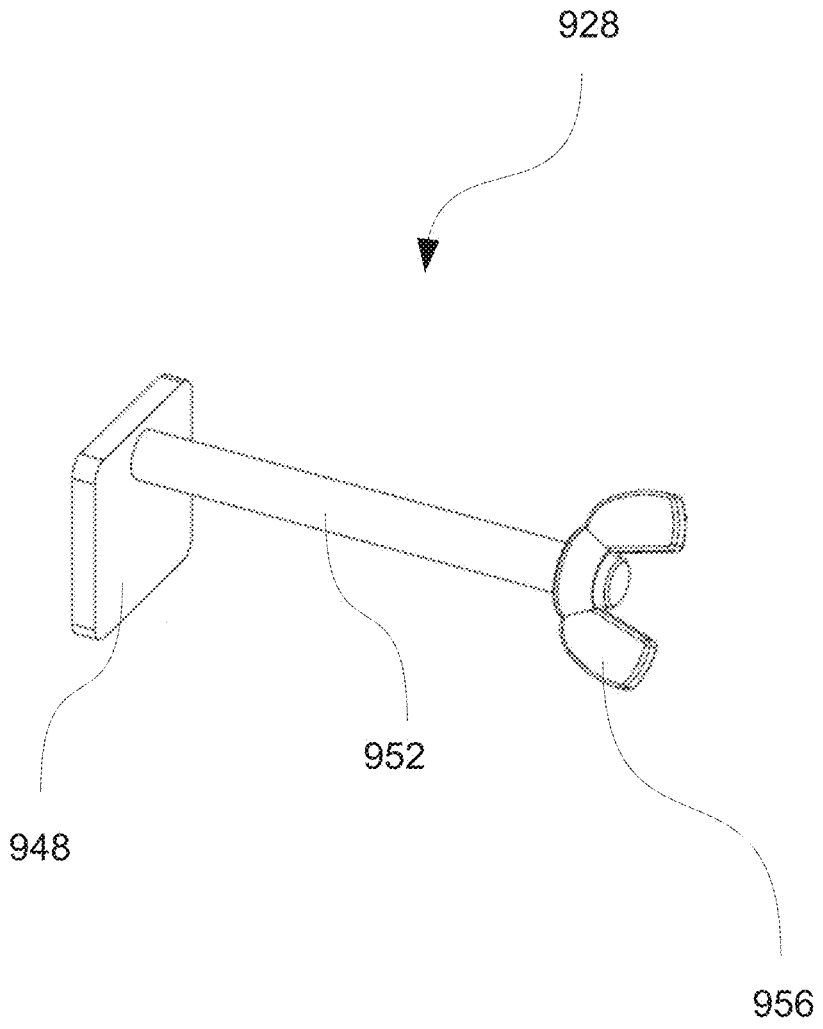
FIG. 10 is a perspective view of an aspect of a rail member according to an embodiment of the present invention.
Figure 11:
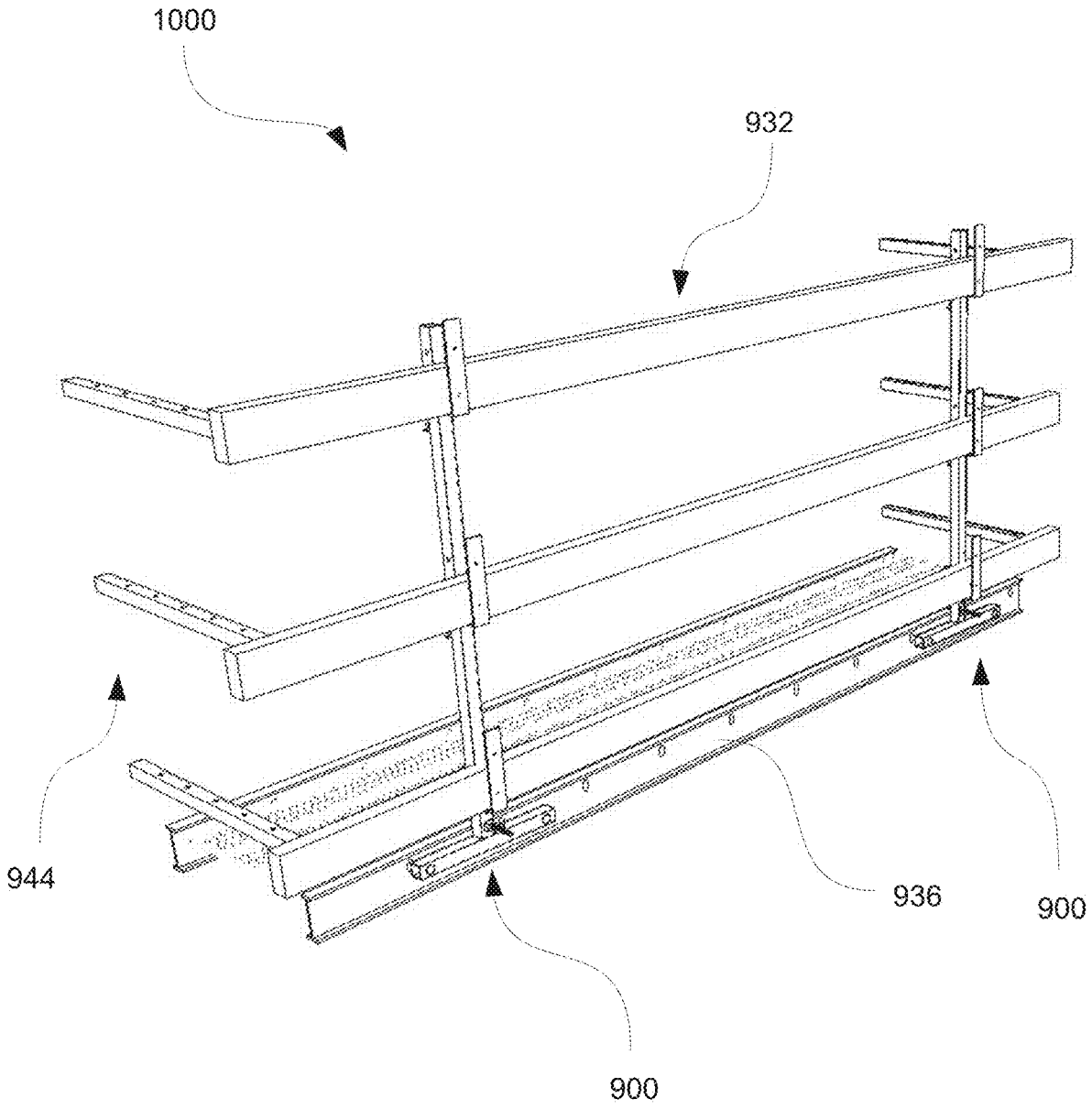
FIG. 11 is a perspective view of rail members in use according to an embodiment of the present invention.
Figure 12:
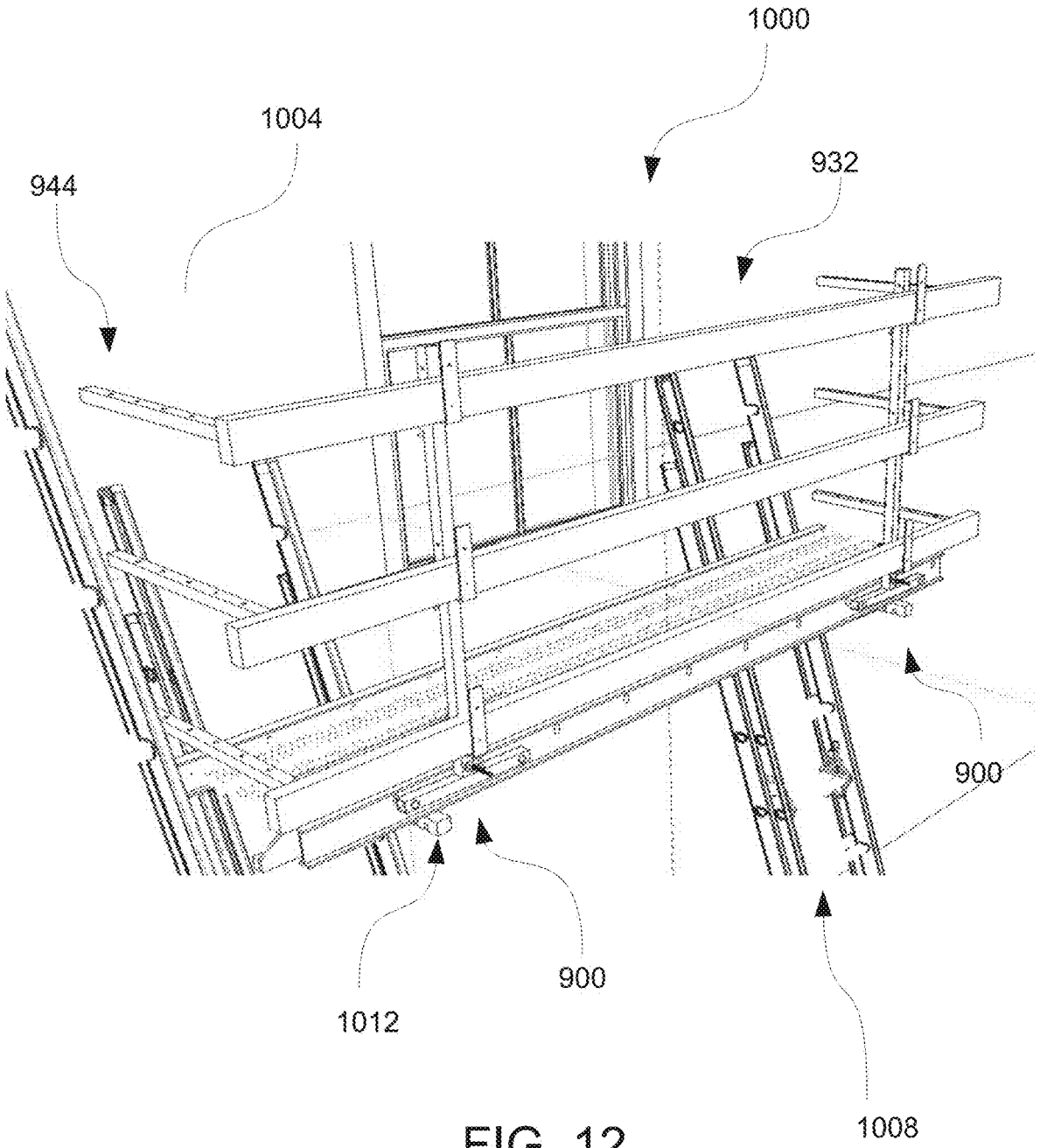
FIG. 12 is another perspective view of rail members in use according to another embodiment of the present invention.

Plank retainer 928 removably couples rail member 900 to platform 936 (shown in FIGS. 11 and 12). In an exemplary embodiment, and as best seen in FIG. 10, plank retainer 928 includes a plate 948, a threaded portion 952, and a coupler 956. In this embodiment, plate 948 is sized and configured to rest against an interior sidewall of platform 936. In an exemplary embodiment, threaded portion 952 is a generally a cylindrical rod, is coupled to plate 948, and includes, along at least a portion of its length, threads. Coupler 956 is a nut or other device that can mate with threaded portion 952. In an exemplary embodiment, coupler 956 is a wing-nut.

In use, platform engagement members 904 are inserted into corresponding apertures found in the sidewall of platform 936, Plate 948 can then be positioned proximate the interior sidewall of platform 936. Threaded portion 952 can (or may have already been) inserted through mounting aperture 924. Coupler 956 is then (or may have already been) coupled to threaded portion 952. Moving coupler 956 along threaded portion 952 further secures rail member 900 to platform 936. Brace holders 920, if not previously installed, can then be installed. Depending on configuration of the staging system or railing system, ones of brace members 932 and end safety rails 944 may be coupled to stanchion 912.

Exemplary embodiments of a rail system 1000 are shown in FIGS. 11 and 12, with the rail system 1000 in FIG. 12 being shown in use on a structure 1004. As shown in FIGS. 11 and 12, a pair of rail members, such as rail members 900, is coupled to a plank 936, in FIG. 11, there is also a plurality of ladders 1008 that serve to support the rail system 1000 via system supports 1012. System supports 1012 and, in certain embodiments, certain ones of end safety rails 944 can couple to ladders 1008 so as to maintain the vertical position of the rail system 1000. When rail member 900 is used with a staging system, such as staging system 400A, rail member 900 would typically be installed in between the staging brackets, such as staging bracket 100. In this embodiment, rail member 900 may additionally include a wall spacer (not shown) that assist in keeping the platform away from the structure.

Rail member 900 may also be coupled to other various supports that allow for the installation of railings at different points of the structure. For example, rail member 900 may couple to a support bracket that attaches to roofing joists such that the rail member extends above the roof line and thereby allows for brace members, such as brace members 132, to be installed while roofers are working. In another example, rail member 900 may be releaseably coupleable to steel beams, exterior walls without roofs, flat roofs, etc.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A rail system comprising:

a platform, the platform including a sidewall with a plurality of apertures;

at least two rail members, each of the at least two rail members attached to the platform and each of the at least two rail members including:

a stanchion having a top, a bottom, a front, a back, a first side, and a second side, and a cross-member bar, the cross-member bar including a plurality of platform engagement bars, wherein the cross-member bar is attached to the bottom of the stanchion and extends substantially perpendicularly out from the first side of the stanchion and the second side of the stanchion, wherein the plurality of platform engagement bars extend substantially perpendicularly out from the cross-member bar in a direction away from the front of the stanchion, wherein the cross-member bar and the plurality of platform engagement bars are below the bottom of the stanchion, and wherein the plurality of platform engagement bars are designed and configured to cooperatively mate with corresponding respective ones of the plurality of apertures of the sidewall; and a brace holder on the stanchion, the brace holder including a bracket with an open top portion, wherein the bracket extends from the back of the stanchion and wherein the bracket is designed and configured to support a brace member and to receive a brace member through the open top portion; and a brace member supported by the brace holder of each of the rail members, thereby forming a safety rail for the platform for which additional securement mechanisms are unnecessary.

2. A rail system according to claim 1, further including a plank retainer for each of the at least two rail members, each plank retainer passing through a respective stanchion and engaging with the sidewall of the platform.

3. A rail system according to claim 1, wherein the plurality of apertures are in a plane and each of the plurality of platform engagement bars mate with corresponding respective ones of the plurality of apertures in the plane.

4. A rail system according to claim 2, wherein each plank retainer includes a plate configured to engage with an interior sidewall of the platform.

5. A rail member according to claim 4, wherein the stanchion includes a mounting aperture suitable for receiving a portion of the plank retainer, the mounting aperture being above each of the plurality of platform engagement bars.

6. A rail member according to claim 1, wherein the cross-member bar and the stanchion form a T-shape.

* * * * *